US011364718B2

(12) United States Patent
Rummelsberger et al.

(10) Patent No.: US 11,364,718 B2
(45) Date of Patent: Jun. 21, 2022

(54) DEVICE AND METHOD FOR REGENERATING A PRINT HEAD

(71) Applicant: Canon Production Printing Holding B.V., Venlo (NL)

(72) Inventors: Christoph Rummelsberger, Ismaning (DE); Ulrich Stoeckle, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 148 days.

(21) Appl. No.: 16/913,569

(22) Filed: Jun. 26, 2020

(65) Prior Publication Data

US 2020/0406614 A1 Dec. 31, 2020

(30) Foreign Application Priority Data

Jun. 28, 2019 (DE) ..... 102019117542.9

(51) Int. Cl.
*B41J 2/045* (2006.01)
*B41J 2/165* (2006.01)

(52) U.S. Cl.
CPC ..... *B41J 2/04571* (2013.01); *B41J 2/04586* (2013.01); *B41J 2/04596* (2013.01); *B41J 2/16517* (2013.01)

(58) Field of Classification Search
CPC ..... B41J 2/04571; B41J 2/04586; B41J 2/14145; B41J 2/04596; B41J 2/16517
See application file for complete search history.

(56) References Cited

U.S. PATENT DOCUMENTS 9,452,607 B2 9/2016 Kuypers et al.
2020/0094554 A1* 3/2020 Orihara ..... B41J 2/04588

OTHER PUBLICATIONS

German Action dated Feb. 10, 2020, for Application No. 10 2019 117 542.9.

* cited by examiner

*Primary Examiner* — Thinh H Nguyen
(74) *Attorney, Agent, or Firm* — The Webb Law Firm

(57) ABSTRACT

In a device for regenerating a print head of an inkjet printing device, a fluid is applied onto the nozzle plate of the print head. The one or more nozzles of the print head can be subsequently operated with one or more no-ejection pulses to produce the effect that fluid is drawn from the nozzle plate into the one or more nozzles and mixes with the ink in the one or more nozzles that the viscosity of the ink in the one or more nozzles is reduced.

13 Claims, 4 Drawing Sheets

DEVICE AND METHOD FOR REGENERATING A PRINT HEAD

CROSS REFERENCE TO RELATED APPLICATIONS

This patent application claims priority to German Patent Application No. 102019117542.9, filed Jun. 28, 2019, which is incorporated herein by reference in its entirety.

BACKGROUND

Field

The disclosure relates to a device for regenerating a print head of an inkjet printing device.

Related Art

An inkjet printing device for printing to a recording medium may comprise at least one print bar having one or more print heads, wherein each print head typically has a plurality of nozzles. The nozzles are respectively configured to eject ink droplets in order to print dots of a print image onto the recording medium.

During printing, a print head is typically contaminated with ink, aerosols, and/or constituents of the recording medium. Furthermore, in a print head the ink dries in operating phases in which no printing takes place. The contamination of the print head and/or the drying of the ink may lead to a negative effect on the print quality and/or to a failure of individual nozzles of the print head.

To clean a print head, and/or to remedy dried or dried-on ink, the one or more nozzles of the print heads may be purged with ink during a cleaning process. However, the purging with ink leads to an increased ink consumption of an inkjet printing device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
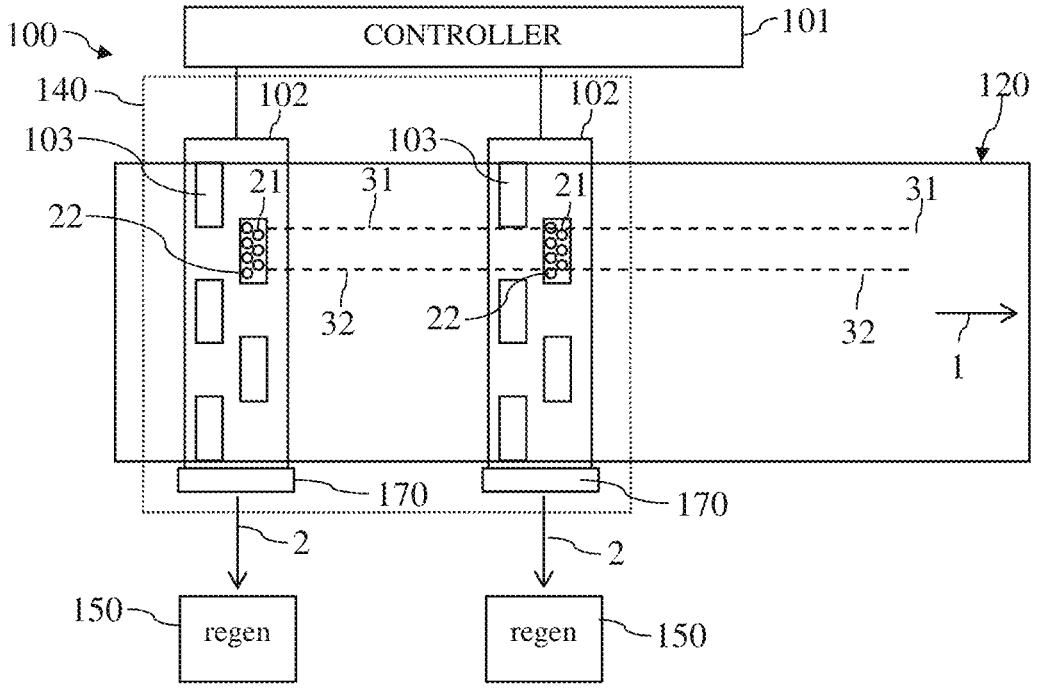
FIG. 1A illustrates an example of an inkjet printing device according to exemplary embodiments.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to reduce the consumption of ink in the regeneration and/or in the cleaning of a print head of an inkjet printing device.

According to one aspect of the disclosure, a device (regeneration device, regenerator) is described. The device can be configured to regenerate a print head of an inkjet printing device which comprises at least one nozzle. A nozzle opening of the nozzle is thereby arranged on a nozzle plate of the print head. The device comprises at least one applicator that is configured to apply a fluid onto the nozzle plate of the print head. The device also comprises a controller that is configured to activate an actuator of the nozzle with at least one no-ejection pulse. The no-ejection pulse is designed such that essentially no ejection of ink from the nozzle is produced by the no-ejection pulse. Moreover, the no-ejection pulse is designed such that an ink meniscus at the nozzle opening of the nozzle is set into motion by the no-ejection pulse such that fluid is conveyed from the nozzle plate into the nozzle and mixes with the ink in said nozzle.

According to a further aspect of the disclosure, a method is described for regenerating a print head of an inkjet printing device, wherein the print head comprises at least nozzle. The method includes the application of a fluid onto the nozzle plate of the print head. Moreover, the method includes the operation of the nozzle with at least one no-ejection pulse in order to convey fluid from the nozzle plate into the nozzle and in order to thereby reduce the viscosity of the ink in the nozzle.

The printing device 100 depicted in FIG. 1*a* is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 comprises two print bars 102, wherein each print bar 102 may be used for printing with ink of a defined color (for example black, cyan, magenta, and/or yellow, and if applicable MICR ink). Furthermore, the printing device 100 typically comprises at least one fixing or drying device (not shown) that is configured to fix a print image printed on the recording medium 120.

A print bar 102 may comprise one or more print heads 103 that are possibly arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of one group of columns 31, 32 of a print image onto the recording medium 120.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 102 of the print group 140 may, for example, comprise multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

The printing device 100 also comprises a controller 101 (for example an activation hardware and/or a processor) that is configured to control the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101, such as controlling the actuators, controlling the cleaner and/or regenerators, and/or controlling one or more operations (including the overall operation) of the printing device 100.

The print group 140 of the printing device 100 thus comprises at least one print bar 102 having K nozzles 21, 22 that may be activated with a defined line clock cycle in order to print a line (transversal to the transport direction 1 of the recording medium 120) with K pixels or K columns 31, 32 of a print image onto the recording medium 120 (with K>1000). In the depicted example, the nozzles 21, 22 are installed immobile or fixed in the printing device 100, and the recording medium 120 is directed past the stationary nozzles 21, 22 with a defined transport velocity.

In an exemplary embodiment, the printing device 100 includes one or more regenerators 150 for the one or more print bars 102. A print bar 102 may be transitioned from a printing position at which the print bar 102 is arranged above the recording medium 120 into a cleaning or service position. For this purpose, the print bar 102 may be moved in the movement direction 2 indicated by an arrow. In the cleaning or service position, the nozzle plates of the one or more print heads 103 of a print bar 102 may then be cleaned, for example wiped off, using a regenerator 150. The printing device 100 may have at least or precisely one regenerator 150 for each print bar 102.

Figure 1B:
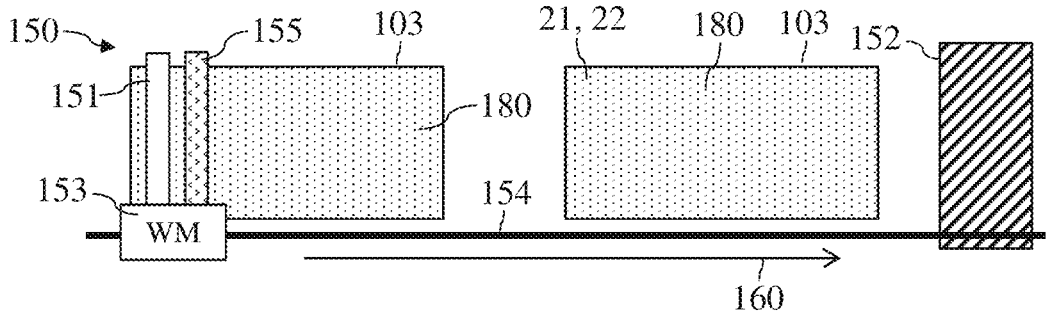
FIG. 1B illustrates a regenerator of an inkjet printing device, in a view from below, according to an exemplary embodiment.
Figure 1C:
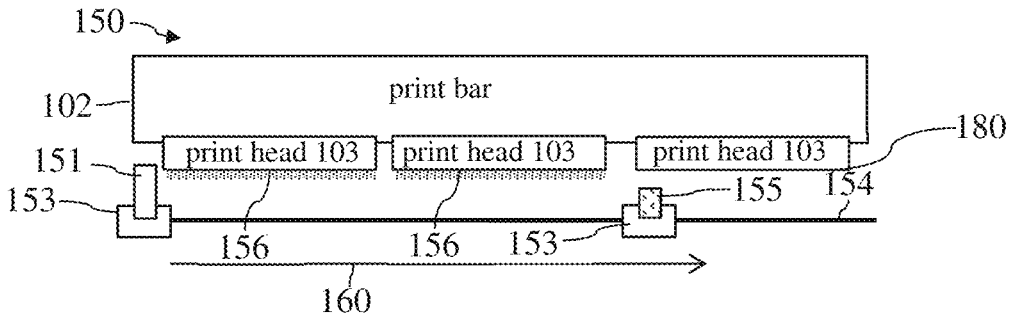
FIG. 1C illustrates a regenerator of an inkjet printing device, in a view from the side, according to an exemplary embodiment.

FIG. 1*b* shows a view of the regenerator 150 from below, toward the nozzle plates 180 of two print heads 103 of a print bar 102, and FIG. 1*c* shows a view of the regenerator 150 from the side, with a print bar 102 having three print heads 103. The print heads 103 are arranged on after another along a cleaning axis 160. The cleaning axis 160 thereby typically travels parallel to the movement direction 2 or, respectively, transversal or orthogonal to the transport direction 1 of the recording medium. The outputs or nozzle openings of the one or more nozzles 21, 22 of the print head 103 are arranged on the underside or the nozzle opening 180 of a print head 103.

In the cleaning or service position, the one or more nozzles 21, 22 of the print head 103 may be induced to eject ink, for example by increasing the pressure within the one or more nozzles 21, 22. This step is typically referred to as "purging". Furthermore, the nozzle plate 180 of a print head 103 may be sprayed with a (cleaning) fluid 156 by one or more spray nozzles 155. The underside or nozzle plate 180 of a print head 103 may subsequently be cleaned with a wiper 151. The wiper 151 may be moved along the cleaning axis 160, across the nozzle plate 180 of a print head 103, in order to clean the nozzle plate 180 of ink that remains on said nozzle plate 180. This step is typically referred to as "wiping".

The wiper 151 and/or a spray nozzle 155 may be attached (separately or together) to a sled or a wiper mount 153 that is directed along a guide rail 154 along the nozzle plate 180 of a print head 103. A sled 153 may thereby guide one or more wipers 151 across the nozzle plates 180 of a plurality of (in particular all) print heads 103 of a print bar 102. The fluid that is thereby wiped off may drip into a basin (not shown), wherein the basin is arranged below the sled 153. After the nozzle plates 180 of the one or more print heads 103 have been wiped off, the wiper 151 may be moved into a cleaning module (cleaner) 152 in which the wiper 151 is cleaned.

Figure 2:
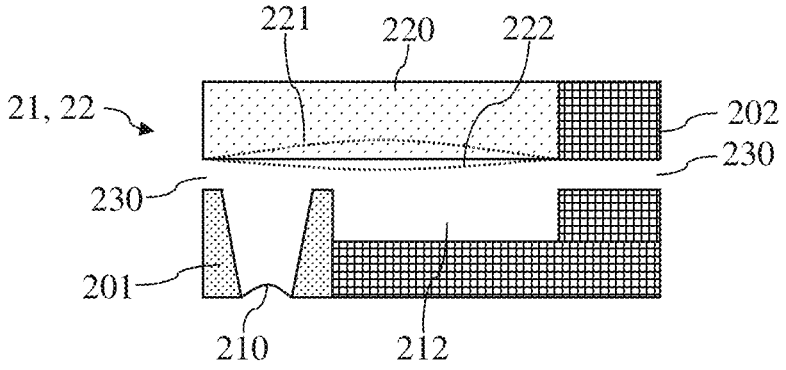
FIG. 2 illustrates a nozzle according to an exemplary embodiment.

The cleaning of a print head 103 of an inkjet printing device is thus linked with a relatively high ink consumption. In the following, a method is described for regenerating a print head 103 with a reduced ink consumption or possibly entirely without ink consumption. In this context, FIG. 2 shows an example of a design of a nozzle 21, 22 of a print head 103. The nozzle 21, 22 comprises walls 202 which, together with an actuator 220, form a receptacle or a pressure chamber 212 to accommodate ink, wherein the pressure chamber 212 is also referred to as an ink chamber 212. An ink droplet may be fired toward the recording medium 120 via a nozzle opening 201 of the nozzle 21, 22. The ink forms what is known as a meniscus 210 at the nozzle opening 201. Furthermore, the nozzle 21, 22 comprises an actuator 220, for example a piezoelectric element, that is configured to vary the volume of the pressure chamber 212 for accommodating the ink or to vary the mechanical pressure of the ink in the pressure chamber 212 of the nozzle 21, 22. In particular, as a result of a deflection 222, the volume of the pressure chamber 212 may be reduced by the actuator 220 and the pressure in the pressure chamber 212 may be increased. An ink droplet is thus ejected from the nozzle 21, 22 via the nozzle opening 201. FIG. 2 shows a corresponding deflection 222 of the actuator 220 as a dotted line. Moreover, the volume of the pressure chamber 212 may be enlarged by the actuator 220, as represented by the deflection 221, in order to draw new ink into the pressure chamber 212 via an ink supply channel 230.

Via a deflection 221, 222 of the actuator 220, the ink within the nozzle 21, 22 may thus be moved, and the ink in the chamber 212 may be placed under mechanical pressure. A defined movement of the actuator 220 thereby produces a corresponding defined movement of the ink. The defined movement of the actuator 220 is typically produced by a corresponding defined waveform or a corresponding defined pulse of an activation signal of the actuator 220. In particular, via a fire pulse, which is also referred to as an ejection pulse, the effect may be produced that the nozzle 21, 22 ejects an ink droplet via the nozzle opening 201. The ejection of ink droplets with different properties may be produced via different types of activation signals at the actuator 220. In particular, the ejection of ink droplets with different droplet size or with different ink quantities maybe produced by different types of activation signals. Furthermore, via a prefire pulse, which is also referred to as a pre-ejection pulse or in general as a no-ejection pulse, the effect may be produced that, although the nozzle 21, 22 produces a movement of the ink and an oscillation of the meniscus 210 at the nozzle output, no ink droplet is thereby ejected via the nozzle opening 201.

In an exemplary embodiment, the regenerator 150 is configured to spray the nozzle plate 180 of a print head 103 with a fluid 156 so that, as illustrated in FIG. 1*c*, a layer of fluid 156 results on the nozzle plate 180. The fluid 156 may be used to dilute the ink contained in the one or more nozzles 21, 22 of the print head 103 in order to reduce the viscosity of the ink and in order to thereby regenerate the print head 103. For this purpose, the one or more nozzles 21, 22 may be operated with one or more no-ejection pulses by which the meniscus 210 in the one or more nozzles 21, 22 is respectively set into motion. The movement of the meniscus 210 of a nozzle 21, 22 may thereby be such that the meniscus 210 of the nozzle 21, 22 is temporarily curved outward, out of the nozzle opening 201, and is thereby wetted with the fluid 156 on the nozzle plate 180, and that the meniscus 210 is temporarily curved inward, toward the chamber 212 of the nozzle 21, 22, and thereby draws the fluid 156 into the chamber 212 of the nozzle 21, 22.

Via the operation of the one or more nozzles 21, 22 of the print head 103 with one or more no-ejection pulses, the effect may thus be produced that the fluid 156 arrives from the nozzle plate 180 into the chambers 212 of the one or more nozzles 21, 22 and is mixed with the ink in the chambers 212 of the one or more nozzles 21, 22, and the viscosity of the ink is thereby reduced. A reliable regeneration of the one or more nozzles 21, 22 of the print head 103 may thus be produced without any ink consumption. The fluid 156 remaining on the nozzle plate 180 of a print head 103 may subsequently be removed from said nozzle plate 180 by means of the wiper 151.

Figure 3A:
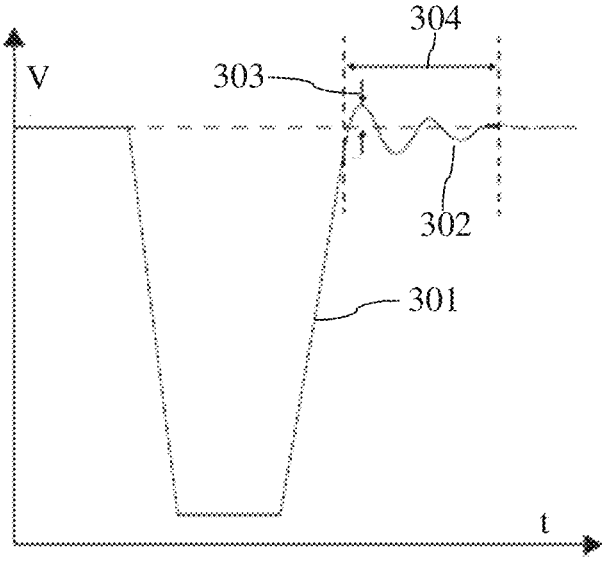
FIG. 3A illustrates a no-ejection pulse with a ringing (post-pulse oscillation) according to an exemplary embodiment.

The no-ejection pulses may also advantageously be used to determine the viscosity of the ink in a nozzle 21, 22. FIG. 3*a* shows an example of a no-ejection pulse 301 as a time curve of the voltage produced at the actuator 220 of a nozzle 21, 22. Furthermore, FIG. 3*a* shows a ringing 302 (post-pulse oscillation) of the actuator 220, produced by the no-ejection pulse 301. The ringing 302 of the actuator 220, meaning the time curve of the electrical voltage at the actuator 220 that describes the ringing 302, may be detected by means of a measurement unit (measurement detector) 170.

Figure 3B:
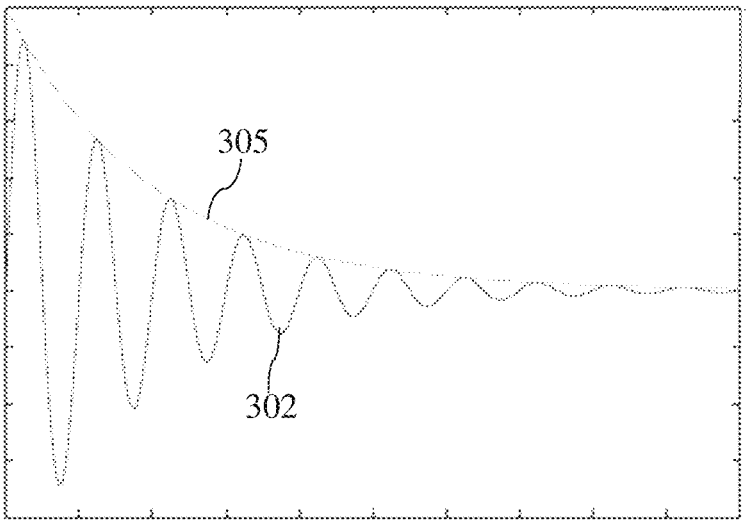
FIG. 3B illustrates an example of a ringing according to an exemplary embodiment.

The ringing 302 has a defined initial amplitude 303 that decays in the ringing time period 304 of the ringing 302. The ringing 302 from FIG. 3*a* is shown enlarged in FIG. 3*b*. In particular, FIG. 3*b* shows the envelope 305 of the ringing 302. The damping or the decay rate of the envelope 305 depends on the viscosity of the ink in the chamber 212 of the nozzle 21, 22. The damping typically increases with increasing viscosity of the ink, and/or the damping decreases with decreasing viscosity of the ink. The damping of the ringing 302 may consequently be used an evidence of the viscosity.

In an exemplary embodiment, to regenerate a nozzle 21, 22, said nozzle 21, 22 may thus be repeatedly operated with no-ejection pulses 301 in order to repeatedly draw fluid 156 from the nozzle plate 180 into the chamber 212 of the nozzle 21, 22 and in order to repeatedly determine viscosity information with regard to the viscosity of the ink on the basis of the ringing 302 of the respective no-ejection pulse 301, in particular on the basis of the damping of the ringing 302 of the respective no-ejection pulse 301. The no-ejection pulses 301 may be repeated until the viscosity information indicates that the ink has a defined target viscosity. The nozzle plate 180 may then be cleaned by a wiper 151, and the nozzle 21, 22 may be reused for the printing of a print image.

Figure 3C:
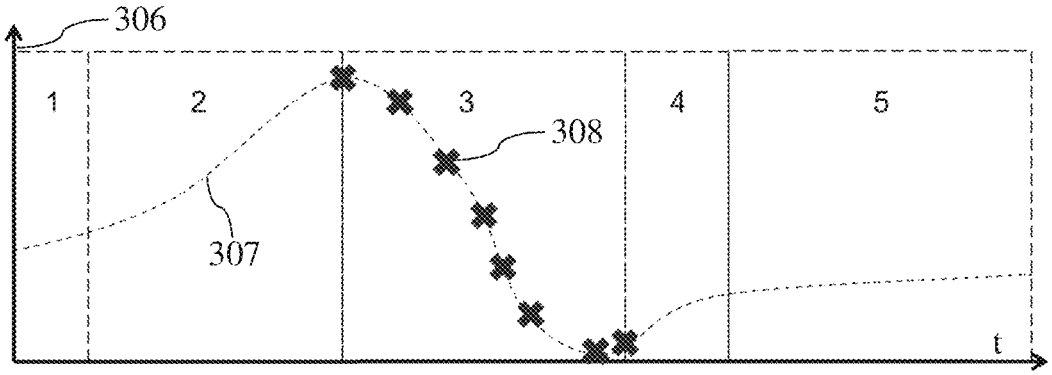
FIG. 3C illustrates an example of a time curve of the viscosity of ink in different operating phases of an inkjet printing device according to an exemplary embodiment.

FIG. 3*c* shows an example of a time curve 307 of the viscosity 306 of the ink in different operating phases of a nozzle 21, 22. During a printing process, meaning during phase 1 in FIG. 3*c*, the viscosity 306 is relatively low and subsequently increases during a printing pause, meaning during phase 2 in FIG. 3*c*. The viscosity 306 may be reduced again in a regeneration phase, meaning in phase 3 in FIG. 3*c*, by means of a sequence of no-ejection pulses 301. FIG. 3*c* thereby shows the individual measurement values 308 of the viscosity that are determined on the basis of the damping of the ringings (e.g. post-pulse oscillations) 302 of the individual no-ejection pulses 301. In a fourth phase, the fluid 156 may be removed from the nozzle plate 180 of the print head 103, and the printing operation may be resumed in a fifth phase. At the beginning of the printing operation, one or more regeneration print images or refresh print images may thereby be printed in order to have the effect that the fluid 156 drawn into the nozzle 21, 22 has been completely fired out of said nozzle 21, 22 before the printing of a usable print image begins. The print quality may be further increased via the printing of one or more regeneration print images.

A regeneration device (regenerator) 150 is thus described for regenerating a print head 103 of an inkjet printing device 100. The print head 103 comprises at least one nozzle 21, 22, wherein the nozzle opening 201 of the nozzle 21, 22 is arranged at the nozzle opening 180 of the print head 103. The regenerator 150 may, for example, be arranged laterally next to the inkjet printing device 100 so that the print head 103 may be moved out of a printing position, above a recording medium 120 to be printed to, to a cleaning position via a movement along the movement direction 2, at which cleaning position the regeneration of the print head 103 may be effected. As depicted in conjunction with FIG. 1*a*, the print head 103 may be part of a print bar 102 having a plurality of print heads 103.

In an exemplary embodiment, the regenerator 150 comprises at least one applicator 155 that is configured to apply a fluid 156 onto the nozzle plate 180 of the print head 103. The applicator 55 may, for example, comprise one or more spray nozzles that are configured to spray fluid 156 onto the nozzle plate 180. The one or more spray nozzles may be directed with a sled 153 along the nozzle plate 180, along the cleaning axis 160, for example as depicted in FIG. 1*c*.

In an exemplary embodiment, the fluid 156 has no color pigments. In particular, the fluid 156 may be designed such that said fluid 156 has a composition corresponding to the ink, apart from the color pigments. In other words, the fluid 156 and the ink may possibly have the same composition, apart from the color pigments.

The ink typically has one or more volatile content substances that evaporate over time and thus lead to an increase in the viscosity of the ink in a nozzle 21, 22, in particular when the nozzle 21, 22 is not operated. The fluid 156 may be designed such that the one or more volatile content substances of the ink may be replaced by the fluid 156. In particular, the fluid 156 may be designed to reduce the viscosity of the ink via mixing with the ink.

In an exemplary embodiment, the regenerator 150 also comprises a controller 101 that is configured to activate or operate the actuator 220 of the nozzle 21, 22 with at least one no-ejection pulse 301. In particular, the nozzle 21, 22 may be operated with one or more no-ejection pulses 301 after the fluid 156 has been applied onto the nozzle plate 180.

Similarly or identical to a pre-ejection pulse, a no-ejection pulse 301 may thereby be such that no ejection of ink from the nozzle 21, 22 is produced by the no-ejection pulse 301. On the other hand, the no-ejection pulse 301 may be designed such that the ink meniscus 210 at the nozzle opening 201 of the nozzle 21, 22 is set into motion by the no-ejection pulse 301. The movement, in particular the oscillation, of the meniscus 301 may thereby be such that fluid 156 is conveyed, in particular drawn, from the nozzle plate 180 into the nozzle 21, 22 and mixes with the ink in said nozzle 21, 22.

The regenerator 150 described in this document for regenerating a print head 103 may thus be configured to apply a fluid 156 onto the nozzle plate 180 of the print head 103, said fluid 156 reducing the viscosity of ink. The one or more nozzles 21, 22 of the print head 103 may subsequently be operated with one or more no-ejection pulses 301 in order to have the effect that fluid 156 is drawn from the nozzle plate 180 into the one or more nozzles 21, 22 and mixes with the ink in the one or more nozzles 21, 22 so that the viscosity of the ink in said one or more nozzles 21, 22 is reduced. An ink-efficient regeneration of a print head 103 may thus be produced.

As has already been presented above, the print head 103 may comprise a plurality of nozzles 21, 22, for example multiple thousands of nozzles 21, 22, that respectively have a nozzle opening 201 at the nozzle plate 180 of the print head 103. The applicator 155 may be configured to apply fluid 156 onto the nozzle plate 180 such that fluid 156 may be conveyed into the respective nozzle 21, 22 by means of one or more no-ejection pulses 301, via the nozzle opening 201 of every single nozzle 21, 22 of the plurality of nozzles 21, 22. In particular, the applicator 155 may be designed to generate a (possibly continuous) layer of fluid 156 onto the nozzle plate 180, wherein the fluid layer essentially entirely covers the nozzle plate 180.

In an exemplary embodiment, the controller 101 is configured to activate the actuators 220 of the plurality of nozzles 21, 22 with one or more respective no-ejection pulses 301 in order to reduce the viscosity of ink in each of the plurality of nozzles 21, 22. The no-ejection pulses 301 of the plurality of nozzles 21, 22 may thereby, if applicable, take place simultaneously or at least with a partial time offset. A regeneration of all nozzles 21, 22 of a print head 103 may thus be efficiently produced.

In an exemplary embodiment, the controller 101 is configured to determine viscosity information with regard to the viscosity of the ink in a nozzle 21, 22. The viscosity information may thereby be determined on the basis of the oscillation behavior of the actuator 220 of the nozzle 21, 22. An oscillation of the actuator 220 with a relatively strong damping typically indicates a relatively high viscosity of the ink. On the other hand, an oscillation of the actuator 220 with relatively little damping indicates a relatively low viscosity of the ink.

In an exemplary embodiment, the nozzle 21, 22 of the print head 103 may then be repeatedly activated with a no-ejection pulse 301 depending on the viscosity information. In particular, the controller 101 may be configured to activate the actuator 220 of the nozzle 21, 22 with no-ejection pulses 301 until the viscosity information indicates that the viscosity of the ink in the nozzle 21, 22 has reached or fallen below a target viscosity value.

Via a repeated operation of the nozzle 21, 22 with no-ejection pulses, the quantity of fluid that is conveyed from the nozzle plate 180 into the nozzle 21, 22 may be adapted. In particular, the quantity of fluid 156 that is mixed with the ink in the nozzle 21, 22 may be increased bit by bit with an increasing number of no-ejection pulses 301. The viscosity of the ink may thus be reduced bit by bit until a defined target viscosity value is achieved. A particularly reliable regeneration of a print head 103 may thus be produced.

In an exemplary embodiment, the regenerator 150 includes a measurement unit 170 that is configured to detect sensor data with regard to a ringing 302 of the actuator 220 of the nozzle 21, 22 as a result of a no-ejection pulse 301. The actuator 220 of the nozzle 21, 22 may, for example, comprise an electromechanical actuator. In particular, the actuator 220 may be designed such that a movement of the actuator 220 is produced via application of an electrical voltage and/or via production of an electrical current. The no-ejection pulse 301 may thus have a time curve of an electrical voltage and/or of an electrical current by which the actuator 220 is set into motion.

On the other hand, the actuator 220 may conversely be designed such that an electrical voltage and/or an electrical current may be produced via a movement of the actuator 220. The measurement unit 170 may be designed to detect sensor data with regard to the time curve of the electrical voltage and/or of the electrical current, said time curve being produced by a ringing 302 of the actuator 220. In an exemplary embodiment, the measurement unit 170 is a sensor. In an exemplary embodiment, the measurement unit 170 includes processor circuitry that is configured to perform one or more operations and/or functions of the measurement unit 170, including detecting sensor data (e.g. detecting an electrical voltage and/or current generated by the movement of the actuator).

In an exemplary embodiment, the controller 101 is configured to determine the viscosity information on the basis of the sensor data of the measurement unit 170. In particular, the controller 101 may be configured to determine an indicator for the damping of the ringing 302 as viscosity information. For example, a damping constant of the time curve of the voltage and/or of the current may be determined on the basis of the detected time curve of the voltage and/or of the current. The value of the damping constant may indicate the value of the viscosity of the ink. A relatively high value of the damping constant may thereby indicate a relatively high viscosity value, and a relatively low value of the damping constant may thereby indicate a relatively low viscosity value.

The viscosity of the ink in a nozzle 21, 22 may be efficiently and precisely determined via the evaluation of the ringing 302 of the one or more no-ejection pulses 301. This enables a precise and efficient regeneration of a print head 103.

In an exemplary embodiment, the controller 101 is configured to repeatedly, in a sequence of points in time t: activate the actuator 220 of the nozzle 21, 22 with a no-ejection pulse 301; determine sensor data with regard to the ringing 302 of the respective no-ejection pulse 301; and determine the respective current viscosity information on the basis of the respective sensor data. A time curve of the viscosity of the ink in the nozzle 21, 22 may thus be determined as a consequence of a sequence of no-ejection pulses for the sequence of points in time. The aforementioned steps may be repeated iteratively until the viscosity information indicates that the regeneration of the print head 103 has concluded, for example until the viscosity information indicates that the viscosity of the ink has reached the target viscosity value. The viscosity of the ink in the one or more nozzles 21, 22 of a print head 103 may be precisely adjusted via an iterative repetition of the production of no-ejection pulses 301 and the determination of respective current items of viscosity information.

Given a print head 103 having a plurality of nozzles 21, 22, the viscosity information may possibly be determined only for a portion of the nozzles 21, 22 of the print head 103. In particular, a measurement unit 170 may possibly be provided only for a portion of the nozzles 21, 22 in order to detect sensor data with regard to the ringing 302 of the actuator 220 of the respective nozzle 21, 22. If applicable, the regenerator 150 is designed such that the viscosity information may be determined only for a single nozzle 21, 22 of the print head 103. The cost efficiency of the regeneration of the print head 103 may be increased via the limitation of the determination of the viscosity information to a portion of the nozzles 21, 22 of a print head 103, in particular to only a single nozzle 21, 22.

Alternatively, individual viscosity information may possibly be determined for every single nozzle 21, 22 of the plurality of nozzles 21, 22 of the print head 103. For example, a measurement unit 170 may be provided for every single nozzle 21, 22 of the plurality of nozzles 21, 22 in order to detect sensor data with regard to the ringing 302 of a no-ejection pulse 301. The controller 101 may also possibly be configured to produce no-ejection pulses 301 individually, depending on the respective viscosity information, for every single nozzle 21, 22 until the respective viscosity information indicates that the viscosity of the ink in the respective nozzle 21, 22 exhibits the target viscosity value. The regenerator 150 may thus be configured to individually adapt the number of no-ejection pulses 301 individually for the individual nozzles 21, 22 of the print head 103. The quality of the regeneration of the print head 103 may thus be increased.

The regenerator 150 may comprise a cleaner 151 that is configured to remove from the nozzle plate 180 fluid 156 remaining on said nozzle plate 180. For example, the cleaner 151 may comprise at least one wiper that may be drawn across the nozzle plate 180 in order to clean the nozzle plate 180. The controller 101 may be configured to determine that the regeneration of the print head 103 has concluded. In reaction to this, the cleaner 151 may be induced to remove from the nozzle plate 180 the fluid 156 remaining on said nozzle plate 180. The quality of the cleaning or, respectively, the regeneration of the print head 103 may thus be further increased.

In an exemplary embodiment, the controller 101 is configured to induce the one or more nozzles 21, 22 to print at least one regeneration print image, in particular a print image having what are known as refresh lines, onto a recording medium 120 after conclusion of the regeneration described in this document. The regeneration print image may thereby be designed such that, after printing said regeneration print image, 90% or more, or preferably 99% or more, of the fluid 156 that was conveyed into the one or more nozzles 21, 22 during the regeneration has been ejected from said one or more nozzles 21, 22 again. The print quality of an inkjet printing device (printer) 100 may be further increased via the printing of a regeneration print image following the described regeneration, and in preparation for the printing of a usable print image.

Furthermore, in this document an inkjet printing device 100 is described that comprises the regenerator 150 described in this document.

Figure 4:
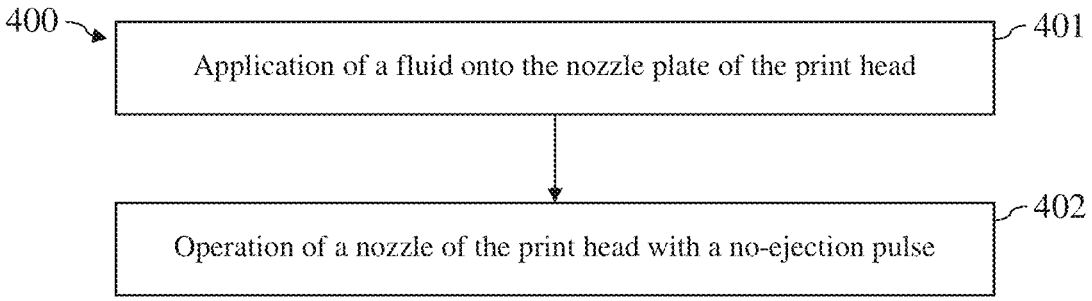
FIG. 4 is a flowchart of a method for regeneration of a print head of an inkjet printing device according to an exemplary embodiment.

FIG. 4 shows a flowchart of a method 400 for regeneration of a print head 103 of an inkjet printing device 100 according to an exemplary embodiment. In this example, the print head 103 includes at least one nozzle 21, 22. In an exemplary embodiment, the method 400 includes the application 401 of a fluid 156, for example a cleaning fluid, onto the nozzle plate 180 of the print head 103. Furthermore, the method 400 includes the operation 402 of the nozzle 21, 22 with at least one no-ejection pulse 301. The no-ejection pulse 301 is thereby designed such that no ejection of ink from the nozzle 21, 22 is produced by the no-ejection pulse 301, and such that the ink meniscus 210 at the nozzle opening 201 of the nozzle 21, 22 is set into motion by the no-ejection pulse 301 such that fluid 156 is conveyed from the nozzle plate 180 into the nozzle 21, 22 and mixes with the ink in said nozzle 21, 22.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print image)
100 printing device (printer)
101 controller
102 print bar
103 print head
120 recording medium
140 print group
150 regenerator
151 cleaner (wiper)
152 cleaning module (cleaner)
153 sled/wiper mount
154 guide rail
155 applicator (spray nozzle)
156 (cleaning) fluid
160 cleaning axis
170 measurement unit (measurement detector/sensor)
180 nozzle plate
201 nozzle opening
202 wall
210 meniscus
212 chamber
220 actuator (piezoelectric element)
221, 222 deflection of the actuator
230 ink supply channel
301 no-ejection pulse
302 ringing (post-pulse oscillation(s))
303 amplitude (ringing)
304 ringing duration
305 envelope (ringing)
306 viscosity
307 time curve of the viscosity
308 measurement value (viscosity)
400 method for regenerating a print head
401-402 method steps

The invention claimed is:

1. A device for regenerating a print head of an inkjet printing device having at least one nozzle, a nozzle opening of the at least one nozzle being arranged at a nozzle plate of the print head, the device comprising:

at least one applicator that is configured to apply a fluid onto the nozzle plate of the print head; and a controller that is configured to activate an actuator of the at least one nozzle with at least one no-ejection pulse, the no-ejection pulse being configured such that:

no ejection of ink from the at least one nozzle is produced by the no-ejection pulse; and an ink meniscus at the nozzle opening of the at least one nozzle is set into motion by the no-ejection pulse such that fluid is conveyed from the nozzle plate into the at least one nozzle and mixes with ink in the at least one nozzle, wherein the controller is further configured to:

determine viscosity information with regard to a viscosity of the ink in the at least one nozzle; and repeatedly activate the at least one nozzle with a no-ejection pulse based on the viscosity information.

2. The device according to claim 1, wherein the controller is configured to activate the actuator of the at least one nozzle with no-ejection pulses until the viscosity information indicates that the viscosity of the ink has reached or fallen below a target viscosity value.

3. The device according to claim 1, wherein:

the device further comprises a sensor that is configured to detect sensor data of a ringing of the actuator of the at least one nozzle resulting from a no-ejection pulse; and the controller is configured to determine the viscosity information based on the sensor data of the sensor.

4. The device according to claim 3, wherein the controller is configured to determine an indicator for a damping of the ringing as the viscosity information.

5. The device according to claim 3, wherein, until the viscosity information indicates that regeneration of the print head has concluded, the controller is configured to repeatedly:

activate the actuator of the at least one nozzle with the no-ejection pulse;

determine the sensor data with regard to the ringing of the no-ejection pulse; and determine the viscosity information based on the sensor data.

6. The device according to claim 5, further comprising a cleaner that is configured to remove fluid remaining on the nozzle plate from the nozzle plate, wherein the controller is configured to:

determine that the regeneration of the print head has concluded; and in response to the determination that the regeneration has concluded, induce the cleaner to remove the fluid remaining on the nozzle plate from said nozzle plate.

7. The device according to claim 1, further comprising a cleaner that is configured to remove fluid remaining on the nozzle plate from the nozzle plate, wherein the controller is configured to:

determine that regeneration of the print head has concluded; and in response to the determination that the regeneration has concluded, induce the cleaner to remove the fluid remaining on the nozzle plate from said nozzle plate.

8. The device according claim 1, wherein the fluid:

has no color pigments;

has a composition corresponding to the ink, apart from the color pigments;

is configured to replace one or more volatile component substances of the ink; or is configured to reduce a viscosity of the ink by mixing with the ink.

9. The device according claim 1, wherein the fluid:

has no color pigments;

has a composition corresponding to the ink, apart from the color pigments;

is configured to replace one or more volatile component substances of the ink; and is configured to reduce a viscosity of the ink by mixing with the ink.

10. The device according to claim 1, wherein the print head comprises a plurality of nozzles that respectively have a nozzle opening at the nozzle plate;

the applicator is configured to apply fluid onto the nozzle plate such that, by the no-ejection pulse, fluid is conveyable into the respective nozzle through the nozzle opening of each of the plurality of nozzles; and the controller is configured to respectively activate respective actuators of the plurality of nozzles with a respective no-ejection pulse to reduce a viscosity of ink in the plurality of nozzles.

11. A printer comprising the device according to claim 1.

12. A method for regenerating a print head of an inkjet printing device having at least one nozzle, a nozzle opening of the at least one nozzle being arranged at a nozzle plate of the print head, the method comprising:

applying a fluid onto the nozzle plate of the print head; and operating the at least one nozzle with at least one no-ejection pulse, the no-ejection pulse being configured such that:

no ejection of ink from the at least one nozzle is produced by the no-ejection pulse;

an ink meniscus at the nozzle opening of the at least one nozzle is set into motion by the no-ejection pulse such that fluid is conveyed from the nozzle plate into the at least one nozzle and mixes with the ink in the at least one nozzle;

determining viscosity information with regard to a viscosity of the ink in the at least one nozzle; and repeatedly activating the at least one nozzle with the no-ejection pulse based on the viscosity information.

13. A non-transitory computer-readable storage medium with an executable program stored thereon, wherein, when executed, the program instructs a processor to perform the method of claim 12.

* * * * *